US007435118B2

(12) United States Patent
Long et al.

(10) Patent No.: US 7,435,118 B2
(45) Date of Patent: Oct. 14, 2008

(54) ANTENNA SWITCH

(75) Inventors: Ji-En Long, ShenZhen (CN); Wei-Nan Kuo, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/824,785

(22) Filed: Jul. 3, 2007

(65) Prior Publication Data

US 2008/0001827 A1 Jan. 3, 2008

(51) Int. Cl.
*H01R 29/00* (2006.01)

(52) U.S. Cl. ..... 439/188; 200/51.09; 200/51.1

(58) Field of Classification Search ..... 439/188, 439/916; 200/51.09, 51.1
See application file for complete search history.

(56) References Cited

U.S. PATENT DOCUMENTS 6,940,029 B1 * 9/2005 Wang et al. ..... 200/315

* cited by examiner

*Primary Examiner*—Tho D Ta
(74) *Attorney, Agent, or Firm*—Wei Te Chung

(57) ABSTRACT

An antenna switch (5) includes an insulative body (50), a guide element (52), a conductive element (53), an actuator (54) and a multiply of signal terminals (51). The conductive element is attached to the guide element, and includes two conductive pieces (531) being parallel and laterally offset with each other. The multiply of signal terminals is secured to the insulative body, and includes contact portions (5111) disposed in a linear line, being parallel to the two conductive pieces and extending toward the conductive element. The actuator is for driving the guide element together with the conductive element to be moveable longitudinally such that the guide element is driven to be at a position where some of the signal terminals are in direct contact with one of the conductive pieces.

17 Claims, 5 Drawing Sheets

ANTENNA SWITCH

BACKGROUND OF THE INVENTION

1. Field of the Invention

The present invention relates to the art of electrical connectors, and more particularly to an antenna switch.

2. The General Background

With the development of radio technology, many kinds of radio devices, such as radio telephones, are available in our daily life. The radio telephones are typically provided with an antenna for receiving signals. In general, through the use of a connector typically named as "an antenna switch", an electrical connection is established between an antenna and a circuit board. For most instances, the antenna switch is required to switch between two different antenna devices, such as an internal antenna and an external antenna, and the circuit board, so as to establish the electrical connection of the internal antenna and the circuit board, or of the external antenna and the circuit board.

SUMMARY OF THE INVENTION

An antenna switch according to an embodiment of the present invention includes an insulative body, a guide element, a conductive element, an actuator and a multiply of signal terminals. The insulative body includes a transverse slot and a longitudinal slot communicating with each other. The guide element is moveable with respect to the insulative body along a longitudinal direction. The guide element includes a longitudinal part received within the longitudinal slot and a transverse part, the transverse part defining a mating surface exposed to the transverse slot. The conductive element is attached to the guide element, and includes two conductive pieces disposed on the mating surface of the transverse part. The two conductive pieces is parallel and laterally offset with each other. The multiply of signal terminals is arranged in a row and secured to the insulative body. The signal terminals includes contact portions disposed in a linear line being parallel to the two conductive pieces, the contact portions of the signal terminals extending to the mating surface of the guide element. The actuator is for driving the guide element together with the conductive element to be moveable longitudinally such that when the guide element is driven to be at a first position, some of the signal terminals are in direct contact with one of the conductive pieces whereby a signal route is connected with an internal antenna; and when the guide element is driven to be at a second position, the other signal terminals are in direct contact with the other conductive piece whereby a signal route is connected with an external antenna.

Other features and advantages of the present invention will become more apparent to those skilled in the art upon examination of the following drawings and detailed description of preferred embodiments, in which:

DETAILED DESCRIPTION OF PREFERRED EMBODIMENT

Figure 1:
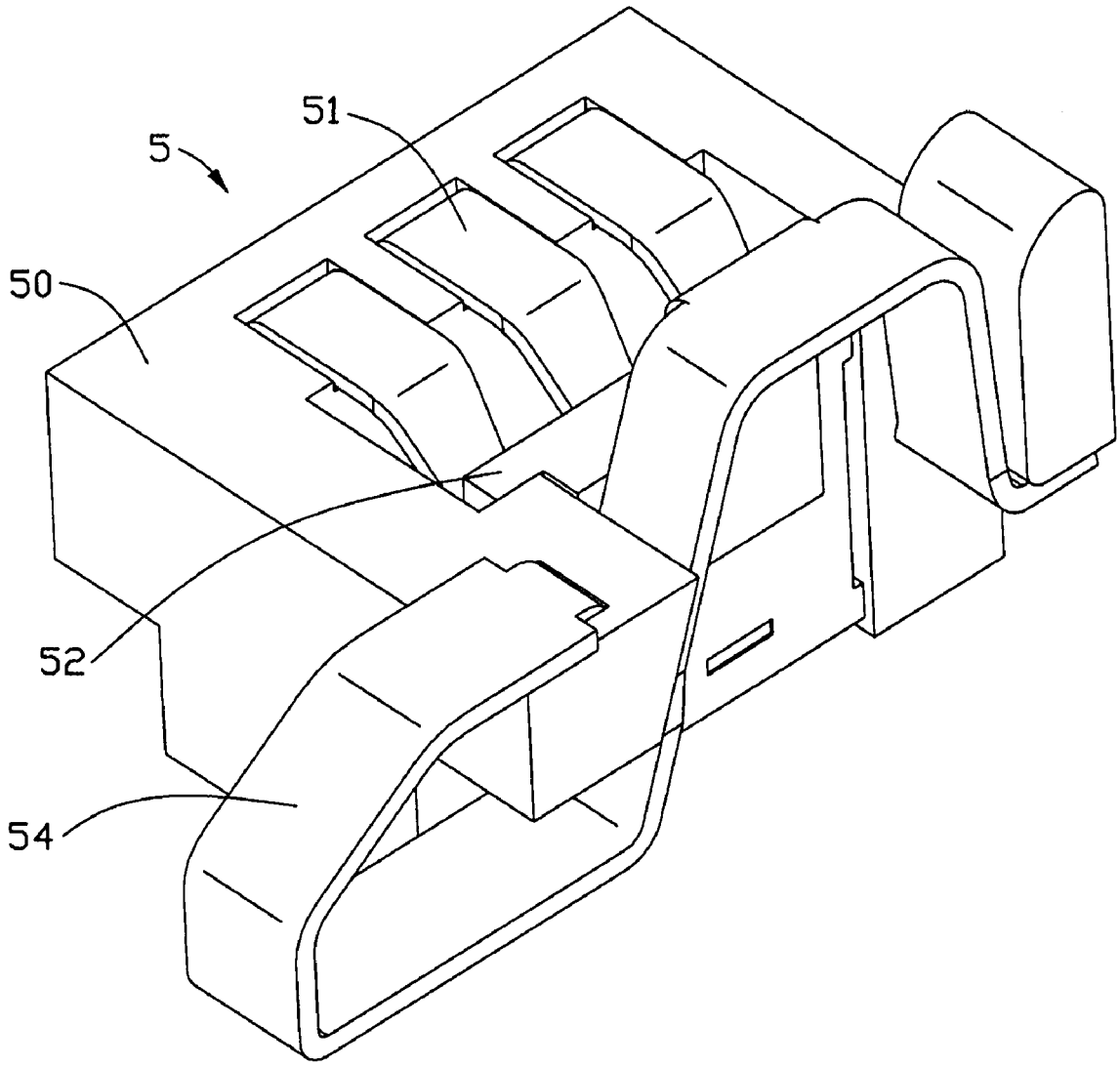
FIG. 1 is an assembled, perspective view of an antenna switch according to an embodiment of the present invention.

Referring to FIGS. 1 to 5, an antenna switch 5 according to an embodiment of the present invention includes an insulative body 50, a multiply of signal terminals 51, a guide element 52, a conductive element 53 and an actuator 54.

The insulative body 50 includes a transverse slot 5011 and a longitudinal slot 5013 communicating with each other. The insulative body 50 is further provided with two different outwardly extending protrusions 502 and 503, disposed adjacent opposite sides of the longitudinal slot 5013, for holding opposite ends of the actuator 54 in position while permitting the actuator 54 together with the guide element 52 to be moveable longitudinally. In addition, three retention apertures 5015 are provided adjacent the transverse slot 5011 for receiving retention portions 510 of the respective signal terminals 51 to secure the signal terminals 51 onto the insulative body 50.

The guide element 52 is moveable with respect to the insulative body 50 along a longitudinal direction. The guide element 52 includes a longitudinal part 522 received within the longitudinal slot 5013, and a transverse part 521 with a mating surface thereof exposed to the transverse slot 5011. The mating surface of the guide element 52 further defines a recessed region 5211 with its shape in correspondence with the outer profile of two conductive pieces 531 so as to enable the two conductive pieces 531 to be received within the recessed region 5211 of the guide element 52. The guide element 52 further includes a first retention slot 5212 longitudinally extending therethrough for receiving an extension arm 5421 of the actuator 54, and second retention slots 5213 for receiving extension legs 5311 of the conductive element 53 so as to enable the conductive element 53 to be attached thereto.

The conductive element 53 is attached to the guide element 52. The conductive element 53 includes two conductive pieces 531 disposed on the mating surface of the transverse part 521. The two conductive pieces 531 are laterally offset with each other and parallel to a line of contact portions 5111 (to be later described) of the signal terminals 51 such that when the guide element 52 is driven to be at a first position (see FIG. 4), two of the three signal terminals 51 are in direct contact with one of the conductive pieces 531 whereby a signal route is connected with an internal antenna, and when the guide element 52 is driven to be at a second position (see FIG. 5), another two signal terminals 51 are in direct contact with the other conductive pieces 531 whereby a signal route is connected with an external antenna. In addition, the conductive element 53 further includes extension legs 5311 extending therefrom for being received within the second retention slots 5213 of the guide element 52.

The multiply of signal terminals 51 is arranged in a row and secured to the insulative body 50. Each of signal terminals 51 includes the retention portion 510 for being received in the retention aperture 5015 of the insulative body 50, and the contact portion 5111 extending downwardly from the retention portion 510 toward the mating surface of the guide element 52 for being in direct contact with one of conductive pieces (to be later described) so as to form an electrical connection with an internal antenna or external antenna. The multiply of signal terminals 51 is configured to have the contact portions 5111 disposed in a linear line being parallel to the two conductive pieces 531.

The actuator 54 is for driving the guide element 52 together with the conductive element 53 to be moveable longitudinally. The actuator 54 has an S-shaped configuration with an extension arm 5421 extending therefrom. The S-shaped actuator 54 has opposite ends held by outwardly extending protrusions 502 and 503 of the insulative body 50, and the extension arm 5421 received within the first retention slot 5212 of the guide element 52 so as to attach the guide element 52 to the actuator 54.

Figure 2:
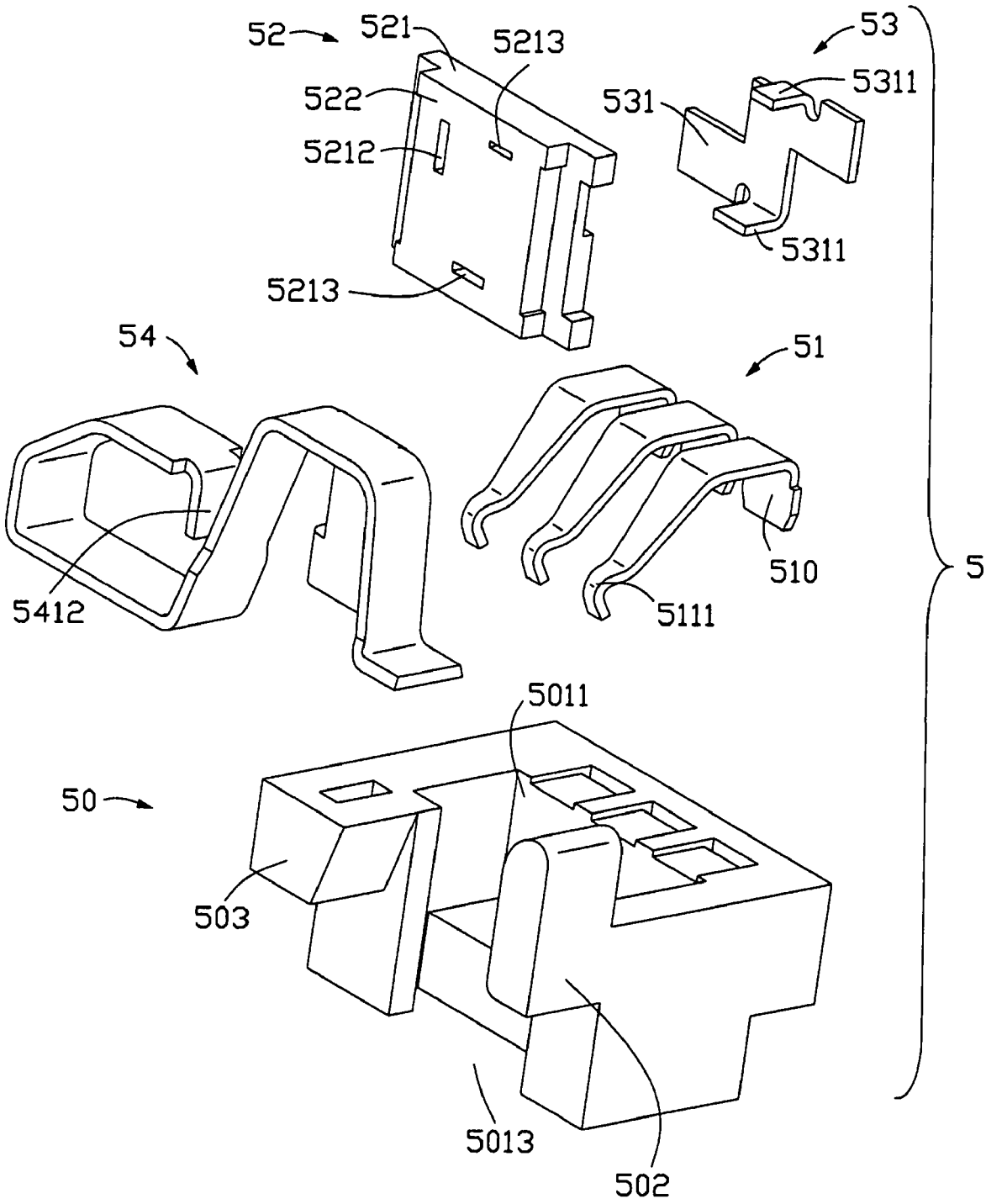
FIG. 2 is an exploded, perspective view of the antenna switch of FIG. 1.
Figure 3:
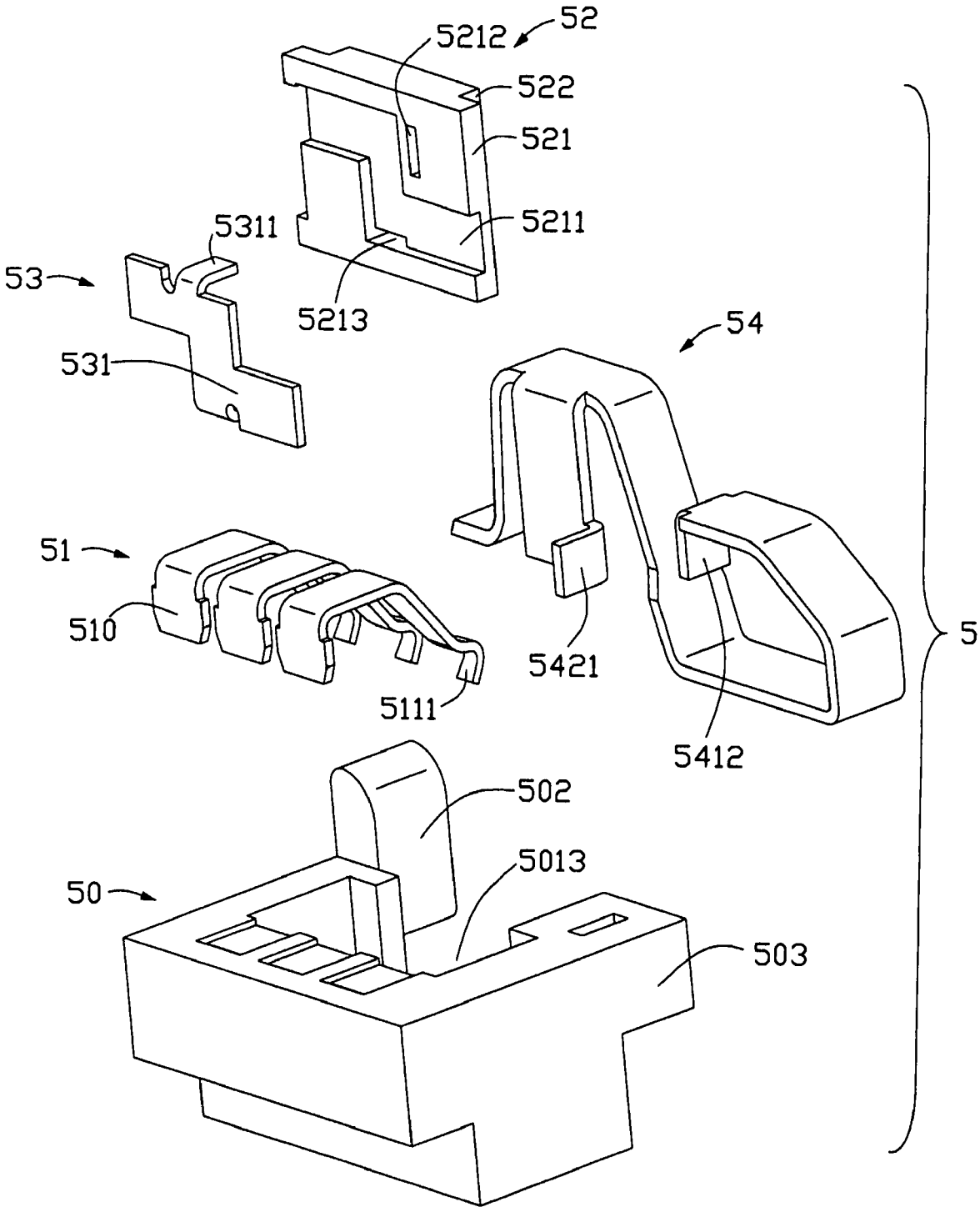
FIG. 3 is another exploded, perspective view of the antenna switch of FIG. 1.

Referring to FIGS. 1 and 2, in assembly, the conductive element 53 is attached to the guide element 52 by its extension legs 5311 received within the second retention slots 5213 of the guide element 52, and the two conductive pieces 531 received in the recessed region 5211 of the guide element 52. The actuator 54 is also attached to the guide element 52 by its extension arm 5421 extending into the first retention slot 5212 of the guide element 52. Then the subassembly of the guide element 52, the conductive element 53 and the actuator 54 is assembled onto the insulative body 50 with the combination of the guide element 52 and the transverse part 521 received within the transverse slot 5011, the longitudinal part 522 received within the longitudinal slot 5013 of the insulative body 50, the opposite ends of the actuator 54 held by the respective protrusions 502 and 503 of the insulative body 50, and a catch 5412 of the insulative body 50 extending into an aperture defined on the protrusion 503 of the insulative body 50. The multiply of signal terminals 51 is secured onto the insulative body 50 by their retention portions 510 insertable into the respective retention aperture 5015 of the insulative body 50 such that the respective contact portions 5111 of the signal terminals 51 are configured to extend toward the mating surface of the guide element 52 so as to be in direct contact with the conductive piece 531.

Figure 4:
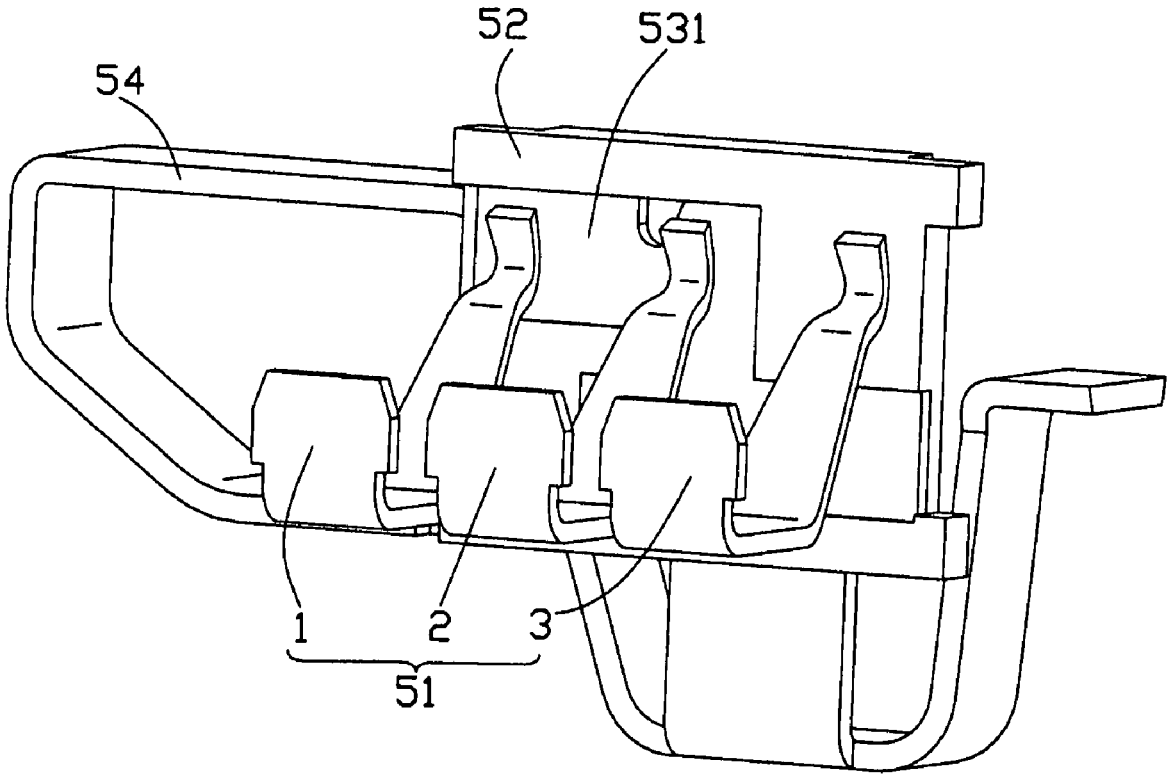
FIG. 4 is a perspective view showing the antenna switch of FIG. 1 to be at a first position where a signal route is connected with an internal antenna, wherein an insulative body of the antenna switch is removed therefrom.
Figure 5:
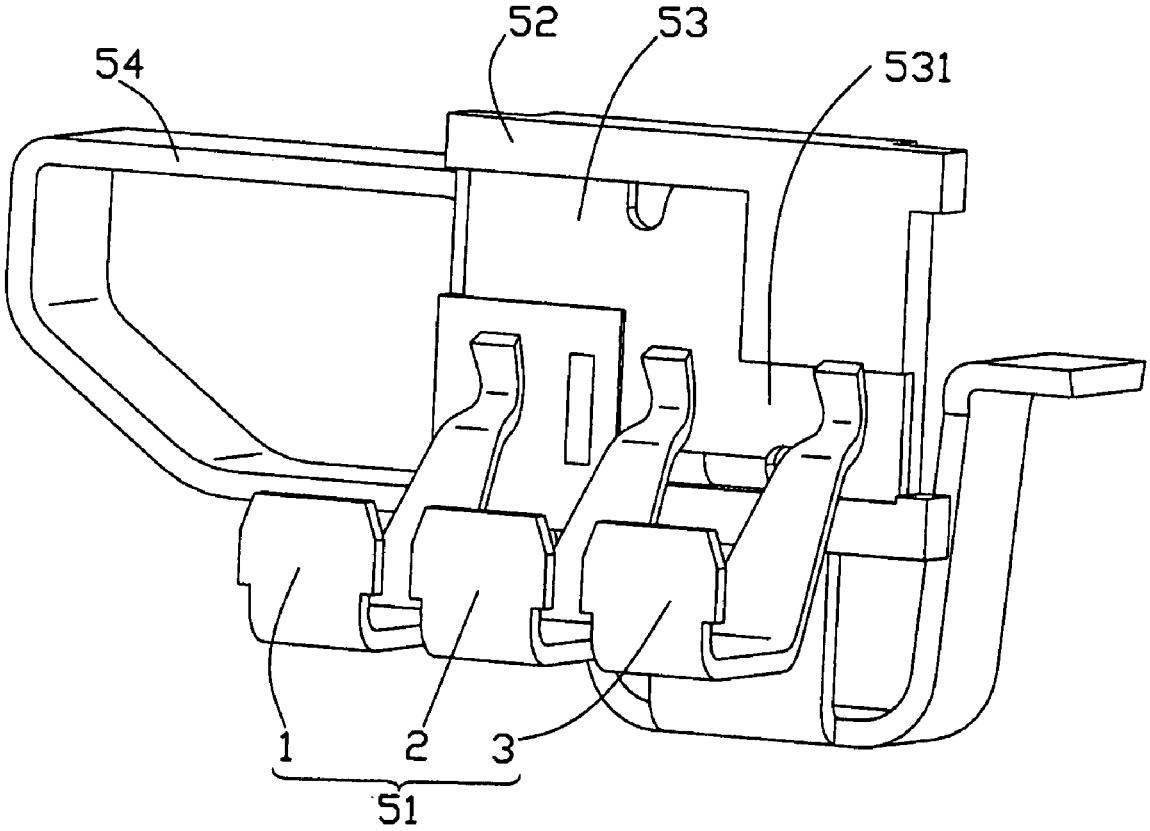
FIG. 5 is a perspective view showing the antenna switch of FIG. 1 to be at a second position where a signal route is connected with an external antenna, wherein an insulative body of the antenna switch is removed therefrom.

Referring to FIGS. 4 and 5, in use, the actuator 54 is operable to drive the guide element 52 together with the conductive element 53 to be moveable longitudinally such that when the guide element 52 is driven to be at a first position (see FIG. 4), first and second signal terminals 51 are in direct contact with one of the conductive pieces 531 whereby a signal route is connected with an internal antenna; and when the guide element 52 is driven to be at a second position (see FIG. 5), the second and third signal terminals 51 are in direct contact with the other conductive piece 531 whereby a signal route is connected with an external antenna.

While the present invention has been described with reference to preferred embodiments, the description of the invention is illustrative and is not to be construed as limiting the invention. Various of modifications to the present invention can be made to preferred embodiments by those skilled in the art without departing from the true spirit and scope of the invention as defined by the appended claims.

What is claimed is:

1. An antenna switch comprising:

an insulative body including a transverse slot and a longitudinal slot communicating with each other;

a guide element moveable with respect to the insulative body along a longitudinal direction, the guide element including a longitudinal part received within the longitudinal slot and a transverse part, the transverse part defining a mating surface exposed to the transverse slot;

a conductive element attached to the guide element, the conductive element including two conductive pieces disposed on the mating surface of the transverse part, the two conductive pieces being parallel and laterally offset with each other;

a multiply of signal terminals arranged in a row and secured to the insulative body, the signal terminals including contact portions disposed in a linear line being parallel to the two conductive pieces, said contact portions of the signal terminals extending to the mating surface of the guide element;

an actuator for driving the guide element together with the conductive element to be moveable longitudinally such that when the guide element is driven to be at a first position, some of the signal terminals are in direct contact with one of the conductive pieces whereby a signal route is connected with an internal antenna; and when the guide element is driven to be at a second position, the other signal terminals are in direct contact with the other conductive piece whereby a signal route is connected with an external antenna.

2. The antenna switch of claim 1, wherein the actuator has an S-shaped configuration with an extension arm extending therefrom, the S-shaped actuator having opposite ends held by the insulative body and said extension arm attached to the guide element.

3. The antenna switch of claim 2, wherein the insulative body includes outwardly extending protrusions for holding the opposite ends of the actuator in position while permitting the actuator to be moveable longitudinally.

4. The. antenna switch of claim 2, wherein the guide element includes a first retention slot for receiving the extension arm of the actuator.

5. The antenna switch of claim 1, wherein the conductive element includes extension legs extending therefrom and the guide element includes second retention slots for receiving the extension legs of the conductive element.

6. The antenna switch of claim 1, wherein the insulative body includes retention apertures for receiving retention portions of the signal terminals to secure the signal terminals to the insulative body.

7. A switch comprising:

an insulative housing;

first, second and third terminals disposed in the housing;

an insulative guiding element moveable back and forth relative to the housing along a first direction; and a conductive element mounted on the guiding element and moved along with said guiding element in said first direction, the conductive element including two conductive pieces being parallel and laterally offset with each other; wherein when the conductive element is moved to a first position, the first and the second terminals are electrically connected via said conductive element; when the conductive element is moved to a second position, the second and third terminals are electrically connected via said conductive element.

8. The switch as claimed in claim 7, wherein said guiding element is operated by a metallic actuator.

9. The switch as claimed in claim 8, wherein said actuator is assembled to the housing in a cantilever manner.

10. The switch as claimed in claim 7, wherein said guiding element is driven to be moveable longitudinally relative to the housing.

11. The switch as claimed in claim 7, further comprising an actuator for driving the guide element together with the conductive element to be moveable longitudinally.

12. The switch as claimed in claim 7, wherein the respective terminals includes contact portions disposed in a linear line parallel to the two conductive piece.

13. A switch comprising:

an insulative housing;

first, second and third terminals disposed in the housing and arranged in sequence along a transverse direction of the housing;

an insulative guiding element moveable up and down relative to the housing along a vertical direction perpendicular to said transverse direction; and a conductive element mounted on the guiding element and moved along with said guiding element in said vertical direction; wherein when the conductive element is moved to an upper position, the first and the second terminals without the third terminal are electrically connected via said conductive element; when the conductive element is moved to a lower position, the second and third terminals without the first terminal are electrically connected via said conductive element.

14. The switch as claimed in claim 13, wherein said guiding element is operated by a metallic actuator.

15. The switch as claimed in claim 14, wherein said actuator is assembled to the housing in a cantilever manner.

16. The switch as claimed in claim 13, wherein the first terminal, the second terminal and the third terminal define respective contacting sections commonly located at a same level for contacting the conductive element.

17. The switch as claimed in claim 16, wherein the conducive element essentially defines at least a Z-shaped configuration so as to respectively contact the contacting sections of said first, second and third terminals when said conductive element is located at said upper and lower positions, respectively.

* * * * *